United States Patent [19]

Tamba et al.

[11] Patent Number: 4,936,263

[45] Date of Patent: Jun. 26, 1990

[54] V-TYPE ENGINE HAVING DIFFERENT EXPLOSION INTERVALS

[75] Inventors: Shinichi Tamba, Kobe; Hitomi Miyake, Miki; Akio Miguchi, Kobe; Yuichi Onaka, Akashi, all of Japan

[73] Assignee: Kawasaki Jukogyo Kabushiki Kaisha, Japan

[21] Appl. No.: 314,787

[22] Filed: Feb. 24, 1989

[51] Int. Cl.[5] ..... F02B 75/22

[52] U.S. Cl. ..... 123/55 VF; 123/90.27; 123/192 R

[58] Field of Search ..... 123/192 R, 55 VS, 55 VE, 123/55 VF, 55 V, 90.27, 90.6

[56] References Cited

U.S. PATENT DOCUMENTS

| | | | |
|---|---|---|---|
| 2,159,209 | 5/1939 | Hazen | 123/53 B |
| 2,295,120 | 9/1942 | Maw | 123/53 B |
| 3,978,828 | 9/1976 | Weber | 123/55 VE |
| 4,370,953 | 2/1983 | Van De Walker | 123/55 VS |

FOREIGN PATENT DOCUMENTS 119155 7/1982 Japan .

*Primary Examiner*—David A. Okonsky
*Attorney, Agent, or Firm*—Leydig, Voit & Mayer

[57] ABSTRACT

An engine comprises a first cylinder and a second cylinder adapted to perform explosions at such timing that an interval from the explosion in the first cylinder to the explosion in the second cylinder is shorter than an interval from the explosion in the second cylinder to the explosion in first cylinder, an intake manifold having an intake passage, and branch passages communicating the intake passage with the first and the second cylinders. The engine has at least one of the construction that an interval from the explosion in the second cylinder to the intake operation of the second cylinder is set longer than the interval from the explosion in the first cylinder to the intake operation of the first cylinder, and the construction that an interval in which intake and exhaust operations of the second cylinder are overlapped is set shorter than an interval in which intake and exhaust operations of the first cylinder are overlapped, so as to reduce misfire during low speed idling and to enable the engine to produce large output power during high load operation.

2 Claims, 3 Drawing Sheets

V-TYPE ENGINE HAVING DIFFERENT EXPLOSION INTERVALS

BACKGROUND OF THE INVENTION

1. Field of the Invention

The present invention relates to an engine, such as a V-type engine, which has different explosion intervals between first and second cylinders.

2. Description of the Prior Art

Conventionally, there has been proposed a V-type engine of the type in which air-fuel mixture is sucked or introduced into a plurality of cylinders through a single intake manifold. Such engine is disclosed in Japanese Patent Unexamined Publication No. 57-119155, for example. In such conventional V-type engine, the construction of the engine is simplified by providing a single intake manifold.

However, since the engine of this type has unequal intake stroke intervals between the first and second cylinders, distribution of fuel into the respective cylinders may be unbalanced and hence air-fuel ratios of the mixtures introduced into the respective cylinders may not necessarily be equal to each other.

Consequently, during low speed idling disadvantageous misfire tends to occur in the cylinder into which fuel is insufficiently charged. Also the conventional engine has such disadvantage that, because of the unbalanced distribution of fuel into the cylinders, sufficient output power cannot be produced during high-speed, high-load operation in which the opening degree of the throttle valve is large.

SUMMARY OF THE INVENTION

It is an object of the present invention to provide an engine of the above-described type which may reduce misfire during low speed idling and to prevent unbalanced distribution of fuel into the respective cylinders during the engine operation with the throttle valve of large opening degree.

According to one aspect of the invention, there is provided an engine comprising: a first cylinder and a second cylinder adapted to perform explosions at such timing that an interval from the explosion in the first cylinder to the explosion in the second cylinder is shorter than an interval from the explosion in the second cylinder to the explosion in the first cylinder; an intake manifold having an intake passage; and a first branch passage and a second branch passage communicating the intake passage with the first and the second cylinders, respectively; the construction being such that an interval from the explosion in the second cylinder to the intake operation of the second cylinder is set longer than an interval from the explosion in the first cylinder to the intake operation of the first cylinder.

According to another aspect of the invention, there is provided an engine comprising: a first cylinder and a second cylinder adapted to perform explosions at such timing that an interval from the explosion in the first cylinder to the explosion in the second cylinder is shorter than an interval from the explosion in the second cylinder to the explosion in the first cylinder; an intake manifold having an intake passage; and a first branch passage and a second branch passage communicating the intake passage with the first and the second cylinders, respectively; the construction being such that an interval in which intake and exhaust operations of the second cylinder are overlapped is set shorter than an interval in which intake and exhaust operations of the first cylinder are overlapped.

The above and other objects, characteristic features and advantages of the invention will become more apparent from the following description when read in conjunction with the accompanying drawings.

DETAILED DESCRIPTION OF THE PREFERRED EMBODIMENT

The invention will now be described with reference to the accompanying drawings.

Figure 1:
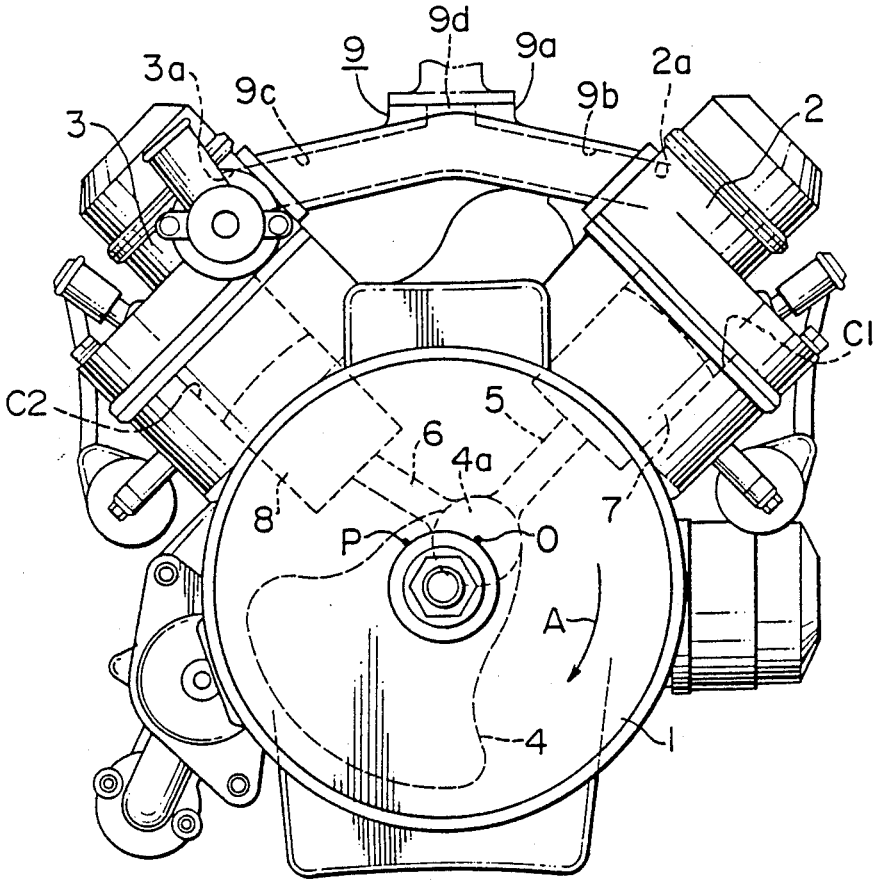
FIG. 1 is a side view of a four-cycle two-cylinder V-type engine to which the present invention may be applied.

Referring to FIG. 1, a four-cycle two-cylinder V-type engine includes cylinder heads 2 and 3 which are arranged on right and left sides, respectively, at an upper portion of a crankcase 1 in such a manner that center axes of first and second cylinders C1 and C2 are interconnected with each other at an angle of 90°, for example, to form a V-shape. A first and a second pistons 7 and 8 are connected to a single crankshaft 4 through a pair of connecting rods 5 and 6. An intake manifold 9 includes an intake pipe *9a* connected to a single carburetor (not shown), and branch passages *9b* and *9c* branched from an intake passage *9d* in the intake pipe *9a* are connected to intake passages *2a* and *3a* of the cylinder heads 2 and 3, respectively. With this construction, an air-fuel mixture is introduced from the carburetor 10 to combustion chambers of the cylinders C1 and C2.

In operation, when the crankshaft 4 is rotated by 270° (360°−90°) in a direction shown by an arrow after explosion in the first or right cylinder C1, a crank pin *4a* is shifted to a point P. At this point P, the explosion in the second or left cylinder C2 will occur. On the other hand, when the crankshaft 4 is rotated by 90°+360° after explosion in the second cylinder C2, the crank pin *4a* is shifted to return to a point 0 again, where the explosion in the first cylinder C1 will occur. More particularly, in this V-type engine, as shown in FIG. 2, an interval $\theta 1$ from the explosion in the first cylinder C1 to the explosion in the second cylinder C2 corresponds to 270° rotation of the crankshaft, while an interval $\theta 2$ from the explosion in the second cylinder C2 to the explosion in the first cylinder C1 corresponds to 450° rotation of the crankshaft, and accordingly the interval $\theta 1$ is shorter than the interval $\theta 2$.

Since the pistons 7 and 8 are connected to the same crank pin *4a* as will be understood from FIG. 1, in the respective cylinders the expansion, exhaust, intake and compression strokes are performed during the same interval, though the respective strokes in one of the cylinders are different in phase from the respective strokes in the other cylinder. On the other hand, since the intervals $\theta 1$ and $\theta 2$ are different from each other, an interval $\theta 3$ from completion of an intake operation of the first cylinder C1 to initiation of an intake operation of the second cylinder C2 will become shorter than an interval $\theta 4$ from completion of the intake operation of the second cylinder C2 to initiation of the intake operation of the first cylinder C1.

Figure 2:
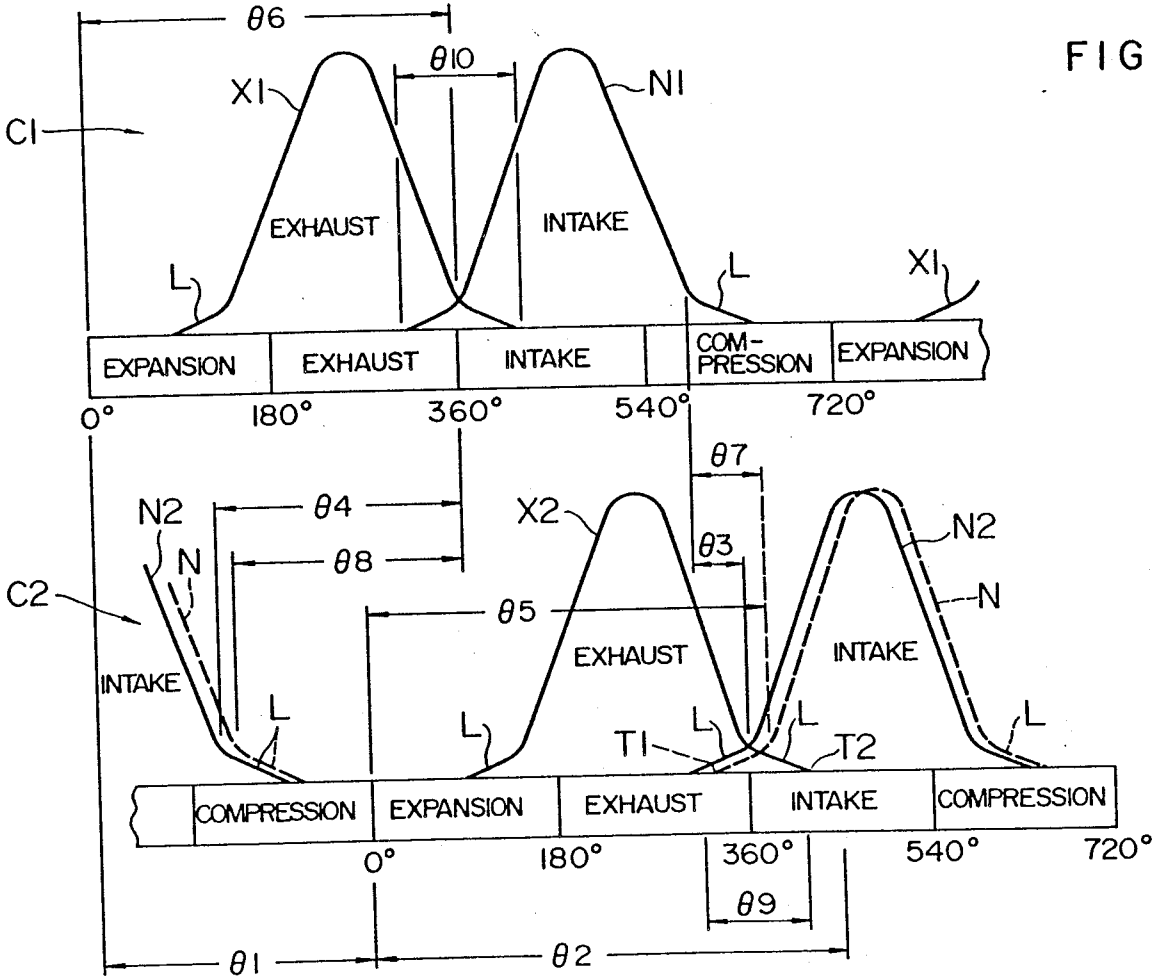
FIG. 2 is a timing chart showing operations of intake and exhaust valves of an engine according to a first embodiment of the invention.

Incidentally, in FIG. 2, N1, N2, X1 and X2 designate lift of an intake valve of the first cylinder C1, lift of an intake valve of the second cylinder C2, lift of an exhaust valve of the first cylinder C1 and lift of an exhaust valve of the second cylinder C2, the intake valves and the exhaust valves being not shown. It should be noted that the "initiation" and "completion" of the intake and exhaust operations mean herein the points of initiation and completion of the main portions of lifts of the intake and the exhaust valves which do not include the portions of the lifts corresponding to ramp portions L shown in FIG. 2.

In the engine wherein the interval $\theta 3$ is shorter than the interval $\theta 4$, the efficiency of fuel charge into the second cylinder C2 is lowered during low speed idling if particular measures for suppressing it are not taken, because of the structure that the fuel is introduced through the same intake passage *9d* into the cylinders. More particularly, during the low speed idling in which the opening degree of the throttle valve (not shown) is small, the intake passage *9d* in the intake manifold 9 and branch passages *9b* and *9c* are remained in a condition of negative pressure for a certain period of time after the intake operation of the first cylinder C1 has been performed. Thus, during the interval $\theta 3$ from the completion of intake operation of the first cylinder C1 to the initiation of intake operation of the second cylinder C2, the negative pressure in the passages *9d, 9b* and *9c* is not released. Consequently, the pressure in the second cylinder C2 is lowered at the intake operation of the latter, with the result that a backward flow of the fuel gas occurs to disadvantageously lower the substantial efficiency of fuel charge into the second cylinder.

Since the second piston 8 is connected through the crankshaft 4 to the first piston 7, the piston 8 continues to operate irrespective of the situation that the efficiency of fuel charge into the second cylinder C2 is low and hence the air-fuel mixture in the cylinder C2 is the lean mixture having large air-fuel ratio. As a result, disadvantageous phenomenon of misfire may occur. Such phenomenon tends to occur not only in the above-described two-cylinder V-type engine but also in the other types of engines, such as a four-cycle horizontal-opposed two-cylinder engine, in which an interval from explosion in a first cylinder to explosion in a second cylinder is different from an interval from explosion in the second cylinder to explosion in the first cylinder.

In the engine of the above-described type, an output power thereof tends to become small during the high-speed, high-load operation in which the opening degree of the throttle valve is large, because of the unbalanced fuel charge into the first and the second cylinders.

The engine according to the invention is constructed to overcome the above-described disadvantages, as will be understood from the description given hereunder.

FIG. 2 is a timing chart showing operations of intake and exhaust valves of an engine according to a first embodiment of the invention. This embodiment is different from the prior art engine in that an interval $\theta 5$ from the explosion in the second cylinder C2 to the intake operation thereof is set to be larger or longer than an interval from the explosion in the first cylinder C1 to the intake operation of the latter. In other words, in this embodiment, the timing of the intake operation of the second cylinder C2, i.e., the timing of opening the intake valve of the second cylinder C2, is delayed as shown by dotted lines N, as compared with the timing of the prior art shown by solid lines N2. It is to be noted that the term "interval" used herein may be interpreted as a time interval, and it corresponds to an angle of rotation of the crankshaft.

As the measure for delaying the timing of opening the intake valve, the embodiment has such structure that a cam of a cam shaft (not shown) is provided on that position of the cam shaft deviated from the position of the prior art cam by an angle of 4° in a direction of rotation of the crankshaft. By such structure, the interval $\theta 5$ is made larger than the interval $\theta 6$ by an angle of 4°.

In this embodiment, since the interval $\theta 5$ is made larger than the interval $\theta 6$ by an angle of 4° as described above, an interval $\theta 7$ from completion of the intake operation of the first cylinder C1 to the initiation of the intake operation of the second cylinder C2 becomes larger by an angle of 4° than the corresponding interval $\theta 3$ of the prior art. Thus, the negative pressure in the intake passage *9d* in the intake manifold 9 and the branch passages *9b, 9c* become small when the intake operation of the second cylinder C2 is initiated, with the result that the efficiency of fuel charge into the second cylinder C2 is improved and hence the possibility of misfire being caused during the low speed idling may be reduced. Further, since the interval $\theta 7$ is made larger than the interval $\theta 3$, the unbalance in output power between the first and second cylinders C1 and C2 may be reduced when the engine is operated under high load with the throttle valve of large opening degree, and hence the entire output power of the engine is enhanced.

Generally, in the engines, there is provided a period or an interval in which exhaust and intake operations of each cylinder are overlapped, i.e., both of an exhaust valve and an intake valve are open. Further, in the case where the negative pressure in the intake passage *9d* and the branch passage *9b, 9c* is large as in the prior art, the pressure in the intake passage, i.e., passage *9c, 3a*, becomes smaller than the pressure in the exhaust passage (not shown). Thus, the tendency is increased that the fuel flows backwardly from the exhaust passage, through the second cylinder C2, to the intake passage *9c, 3a* during the period or the interval from the completion of the exhaust operation to the initiation of the intake operation. This may cause misfire and an unbalance in output power between the cylinders C1 and C2.

In the embodiment of FIG. 2, the timing of the intake operation of the second cylinder C2 is delayed as shown by the dotted lines N, and the timing of the exhaust operation is made identical with that of the prior art. As a result, the point of time T1 when the intake operation of the second cylinder is initiated, i.e., the intake valve initiates to open, approaches the point of time T2 when the exhaust operation of the second cylinder is completed, i.e., the exhaust valve is completely closed. Thus, the interval $\theta 9$ in which the intake and exhaust operations of the second cylinder C2 are overlapped is made shorter or smaller than the interval $\theta 10$ in which the intake and exhaust operations of the first cylinder C1 is overlapped, whereby the possibility of the backward fuel flow being caused may be reduced and the substantial efficiency in fuel charge into the second cylinder is improved. Thus, the misfire and the unbalance in output power between the cylinders C1 and C2 may be prevented. It is herein to be noted that this advantage is obtained by making the interval $\theta 9$ smaller than the interval θ10, and that the timing of operation of the exhaust valve of the second cylinder C2 is not essential. In other words, it is not necessarily required to set the timing of the exhaust valve operation of the second cylinder C2 identical with the timing of the exhaust valve operation of the first cylinder C1.

In the embodiment of FIG. 2, the timing of the intake operation of the second cylinder C2 is delayed as described above. However, it is possible to reduce misfire during low speed idling by advancing (i.e., shifting leftwardly in FIG. 2) the timing of the intake operation of the first cylinder C1. Also it is possible to advance the timing of the intake operation of the first cylinder C1 and at the same time to delay the timing of the intake operation of the second cylinder C2. According to the inventors' experiments conducted on an engine in which the ratio of the interval θ7 to the interval θ8 is set to be about 1:9, there was the case where the occurrence of misfire was reduced to or below 1/10 to 1/20 when the difference between the interval θ5 and the interval θ6 was varied from 0° to 4°.

In the embodiment of FIG. 2, the timing of the exhaust operation of the second cylinder C2 is not changed and made identical with that of the prior art. It is, however, to be noted that the advantage of reducing misfire may be obtained by changing the timing of the exhaust operation of the second cylinder.

Figure 3:
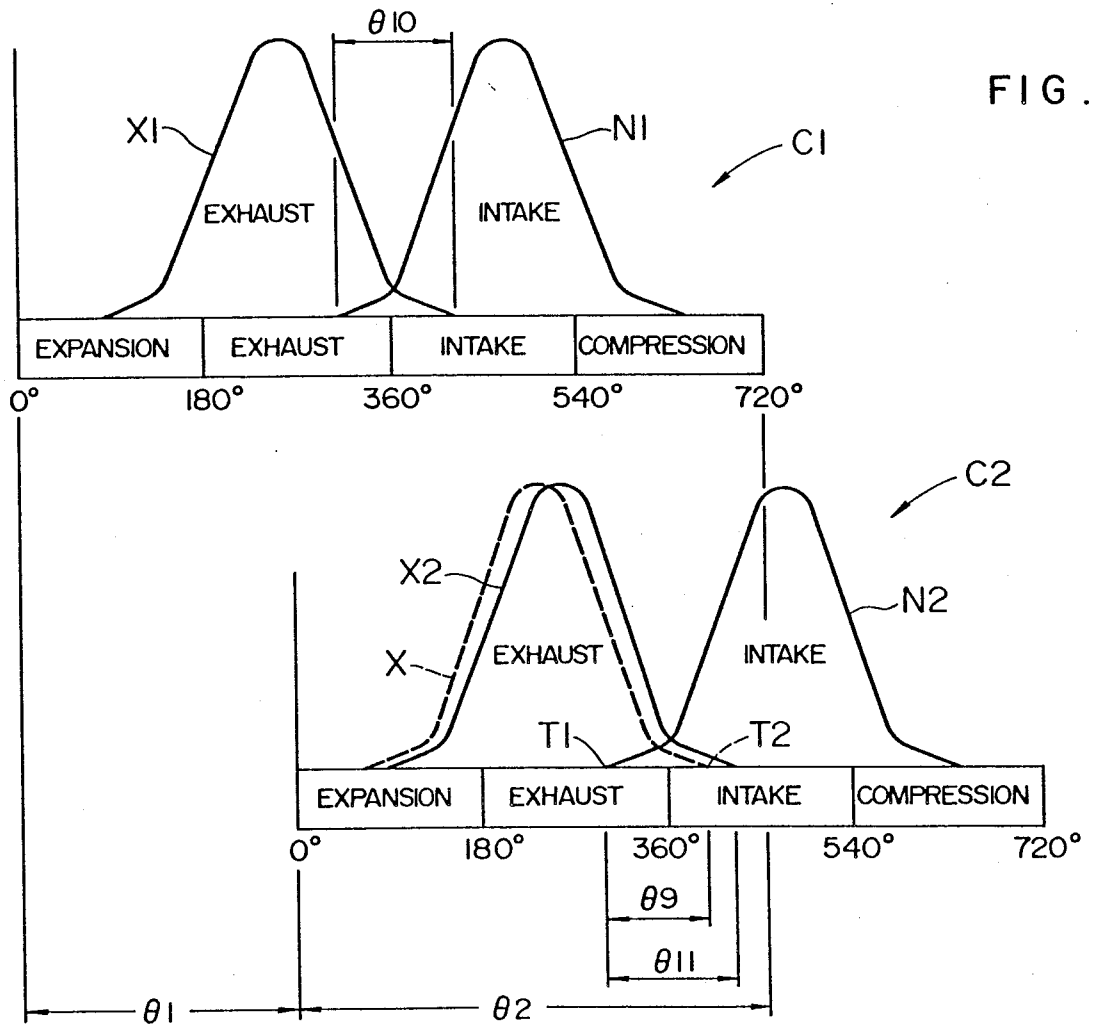
FIG. 3 is a timing chart showing operations of intake and exhaust valves of an engine according to a second embodiment of the invention.

FIG. 3 shows a second embodiment of the invention. This second embodiment is different from the prior art in that the timing of the exhaust valve operation of the second cylinder C2 is advanced as shown by a dotted line X, as compared with the timing of the prior art as shown by a solid line X2. By this advancement of the timing, the interval θ9 in which exhaust and intake operations of the second cylinder C2 are overlapped, or both of the exhaust valve and the intake valve of the second cylinder C2 are opened, is made smaller than the corresponding interval θ10 of the first cylinder C1. Also in this second embodiment, there is obtained the advantages of reducing misfire during low speed idling, improving specific fuel consumption and making larger the engine output power.

Further, it is possible to combine the structure of the first embodiment with the structure of the second embodiment. More particularly, it is possible to delay the timing of the intake valve operation of the second cylinder C2 and to advance the timing of the exhaust valve operation of the second cylinder.

The invention has been described with regard to the V-type engine having a single crank pin. However, it is to be noted that the invention is applicable to any type of engines in which the intervals θ1 and θ2 between explosions in the first and the second cylinders are different from each other. For example, it is applicable to a V-type engine which has two crank pins and an angle between the cylinders and an angle between the crank pins are different from each other. Also it is applicable to a four-cycle horizontal-opposed two-cylinder engine having a single crank pin.

Further, although the invention has been described with regard to the 4-cycle engine, it is applicable to a 2-cycle engine. When the invention is applied to the 2-cycle engine, there may be adopted such structure that the position of the intake port or the exhaust port opened to the second cylinder is slightly deviated from the position of the intake port or the exhaust port opened to the first cylinder in directions of movements of the pistons.

As will be understood from the foregoing description, according to the invention, the interval from the completion of the intake operation of the first cylinder to the initiation of the intake operation of the second cylinder is made larger than that of the prior art, or the interval in which the exhaust and intake operations of the second cylinder are overlapped is made smaller than that of the prior art. As a result, there are obtained the advantages of reducing misfire during low speed idling and of producing large engine output power during high load operation with throttle valve of large opening degree.

What is claimed is:

1. An engine comprising:

a first cylinder and a second cylinder adapted to perform explosions at such timing that an interval from the explosion in said first cylinder to the explosion in said second cylinder is shorter than an interval from the explosion in said second cylinder to the explosion in said first cylinder;

an intake manifold having an intake passage; and a first branch passage and a second branch passage communicating said intake passage with said first and said second cylinders, respectively;

the construction being such that an interval from the explosion in said second cylinder to the intake operation of said second cylinder is set longer than an interval from the explosion in said first cylinder to the intake operation of said first cylinder.

2. An engine comprising:

a first cylinder and a second cylinder adapted to perform explosions at such timing that an interval from the explosion in said first cylinder to the explosion in said second cylinder is shorter than an interval from the explosion in said second cylinder to the explosion in said first cylinder;

an intake manifold having an intake passage; and a first branch passage and a second branch passage communicating said intake passage with said first and said second cylinders, respectively;

the construction being such that an interval in which intake and exhaust operations of said second cylinder are overlapped is set shorter than an interval in which intake and exhaust operations of said first cylinder are overlapped.

* * * * *